United States Patent [19]

Zuendt et al.

[11] 4,225,351

[45] Sep. 30, 1980

[54] NON-CHROMATE CONVERSION COATINGS

[75] Inventors: Richard F. Zuendt, Oradell; Ajay M. Bengali, Hackensack; Philip D. Readio, Sparta; John L. H. Allan, Glen Rock, all of N.J.

[73] Assignee: Dart Industries Inc., Los Angeles, Calif.

[21] Appl. No.: 45,162

[22] Filed: Jun. 4, 1979

Related U.S. Application Data

[63] Continuation-in-part of Ser. No. 955,812, Oct. 30, 1978, abandoned.

[51] Int. Cl.[2] ..... C09D 5/08; C23F 7/00

[52] U.S. Cl. ..... 106/14.12; 106/14.13; 106/14.21; 106/14.45; 148/6.17; 148/6.24; 148/6.27; 148/31.5; 252/79.4; 252/387; 252/389 A; 252/396; 428/470

[58] Field of Search ..... 106/14.12, 14.45, 14.13, 106/14.21; 148/6.17, 6.24, 6.27, 31.5; 156/665, 666; 422/15, 16, 17; 428/470; 252/79.4, 387, 389 A, 396

[56] References Cited

U.S. PATENT DOCUMENTS

| | | | |
|---|---|---|---|
| 3,663,441 | 5/1972 | Gucca | 252/79.4 |
| 3,668,131 | 6/1972 | Banush et al. | 252/79.4 |
| 4,158,592 | 6/1979 | Readio et al. | 252/79.4 |

*Primary Examiner*—Lorenzo B. Hayes

*Attorney, Agent, or Firm*—Bryant W. Brennan; Harold R. Beck

[57] ABSTRACT

Improved brightness and corrosion resistance are imparted to metal surfaces such as zinc plated surfaces, by treatment with a non-toxic solution comprised of sulfuric acid, hydrogen peroxide, a silicate, certain primary organophosphorus compound promoters and at least one secondary promoter selected from ascorbic acid, boric acid, gluconic acid, glycolic acid, tartaric acid and salts of said acids.

29 Claims, No Drawings

NON-CHROMATE CONVERSION COATINGS

This application is a continuation-in-part of pending application Ser. No. 955,812, filed Oct. 30, 1978, now abandoned.

BACKGROUND OF THE INVENTION

The formation of chromate conversion coatings on surfaces of various metals, such as zinc and cadmium, is presently the most common technique of imparting increased brightness and corrosion resistance to the metal. In a typical process, the metal work pieces are immersed in an acidic solution containing hexavalent chromium compounds, which react with the metal causing the precipitation of a complex gel-like coating or film of trivalent chromium and entrapped soluble hexavalent chromium compounds onto the metal surface. The coated work pieces are then rinsed and dried under controlled conditions.

There are several serious disadvantages common to all chromate conversion coating processes. One of these is the relatively short life of the process bath expressed in terms of unit surface area coated per unit volume of bath. The main reason for the short life is the continuous build-up in the bath of dissolved trivalent chromium resulting from the oxidation-reduction reactions that occur between the metal and the hexavalent chromium. Trivalent chromium is a contaminant in the process affecting the coating efficiency. Thus, when reduced coating activity is noted, or when the contaminants have built up to a certain predetermined level, a process solution of this type is at least partially replaced with freshly prepared solution, and ultimately completely discarded in favor of a fresh bath.

The disposal of the spent process solution is wasteful, as the solution still contains considerable quantities of hexavalent chromium. Not only does the loss of these values contribute significantly to the overall cost of the coating process, but disposal also adds to this cost in that the solutions present a substantial waste treatment problem. Hexavalent chromium is highly toxic and must be reduced to the trivalent form, e.g. by reaction with sodium hydrosulfite or sodium bisulfite, and is thereafter precipitated from solution by addition of alkalies, such as sodium carbonate or lime. After dewatering of the precipitate by settling or filtration, the concentrated sludge of trivalent chromium hydroxide must be disposed of in specially designated areas, since trivalent chromium is still too toxic to be used as landfill. Substantial waste treatment requirements of spent rinse waters are also created due to dragout of toxic chemicals from the process bath into subsequent rinse waters. Although there are integrated processes for the reoxidation and regeneration of spent chromate solutions and rinse water, the smaller processor usually finds that the refined and sophisticated techniques involved are neither practical nor economically feasible for solving his waste treatment problems.

In our copending application Ser. No. 955,812, filed Oct. 30, 1978, which application is incorporated into this application by reference, we have disclosed a novel non-toxic conversion coating solution which is comprised of sulfuric acid, hydrogen peroxide, a soluble silicate and a primary promoter, i.e. certain organophosphorus compounds for further enhancement of corrosion resistance of metal surfaces treated with the solution.

Although the acidic silicate "solution" may or may not be a true solution but rather in the form of a hydrosol, for the purpose of this application, the term "solution" is intended to cover a hydrosol as well as a true solution.

In addition to the formation of conversion coatings of excellent properties, there are many other important advantages of the invention described in the aforementioned application. One of these is the extremely long life of the conversion coating solution before it is discarded in favor of a fresh solution. It has been found tha the solutions are capable of treating up to approximately 185 $m^2$ of surface area per liter, which is far superior to the typical value of approximately 20 $m^2/l$ obtained with conventional chromate conversion coating baths.

Another and related advantage is that, apart from some build-up of dissolved metal in the solution, there are no detrimental by-products forming and accumulating therein during use, as is the case with conventional chromate conversion coating solutions, in which trivalent chromium rapidly builds up.

The most important advantage, however, is the non-toxic nature of the system, which greatly facilitates waste disposal of spent solutions from the conversion coating process. Rinse waters can usually be disposed of without any treatment required. Spent conversion coating baths are merely treated with lime for neutralization and removal of dissolved metal ions and phosphorus as a precipitate. After settling or other separation, the liquid phase may be disposed of safely in common sewers, while the dewatered sludge mainly composed of silicate can be dumped in municipal landfill areas.

An object of the present invention is to provide a novel conversion coating and a method of its forming, which coating exhibits brightness and further improved corrosion resistance.

Another object is to provide a non-toxic, conversion coating solution which imparts a superior corrosion resistance to metal surfaces.

Still another object is to provide bright, decorative work pieces of superior corrosion resistance.

These and other objects will become apparent from the following specification, examples and claims.

THE INVENTION

In accordance with the present invention there is provided a novel conversion coating solution which comprises an aqueous solution of from about 0.2 g/l to about 45 g/l of free $H_2SO_4$, from about 1.5 g/l to about 58 g/l of $H_2O_2$, from about 3 g/l to about 33 g/l of $SiO_2$, from about 0.15 g/l to about 10 g/l of at least one of the organophosphorus compound promoters specified below and from about 2 g/l to about 20 g/l of at least one secondary promoter selected from the group consisting of ascorbic acid, boric acid, gluconic acid, glycolic acid, tartaric acid and salts of said acids, wherein the organic phosphorus compound is one having the general formula:

$$[X(R_1)_m]_n.[R_2]_p.[X(R_1)_m]_q,$$

wherein

X is a group of the formula

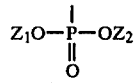

in which $Z_1$ and $Z_2$ independent from each other are hydrogen, sodium or potassium;

m is either 0 or 1;

p is either 0 or 1;

n+q is either (a) 1 when p=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

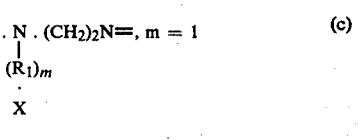

(c)

and (d) a $C_1$–$C_4$ alkylene or a $C_1$–$C_4$ hydroxy-substituted alkylene, m=0 or 1.

The $SiO_2$ component is conveniently provided in the form of a soluble silicate, e.g. sodium silicate or potassium silicate, of predetermined contents of $SiO_2$ and $Na_2O$ or $K_2O$. The mole ratios of $SiO_2$ to either $Na_2O$ or $K_2O$ generally range between 1 and 4, and it is preferred to use those silicates wherein the mole ratio is at least about 1.8 and most preferably at least about 2.2 Ammonium or lithium silicates are also useful in providing the $SiO_2$ component.

Examples of the organophosphorus compounds include $C_1$–$C_4$ alkyl phosphonic acids, $C_1$–$C_4$ hydroxyalkalenephosphonic acids, amino tri-$C_1$–$C_4$ alkylene phosphonic acids, $C_2$–$C_8$ alkylene diamine-tetra ($C_1$–$C_4$ alkylene phosphonic acid), diethylenetriaminepenta ($C_1$–$C_4$ alkylene phosphonic acid) as well as the acid or neutral sodium or potassium salts of any of the above-listed phosphonic acids. 1-hydroxyethylidene-1,1-diphosphonic acid is a preferred compound.

The secondary additives can either be provided in the acid form or as a salt, e.g. of sodium, potassium, zinc, etc.

The solution is easily prepared, e.g. by first adding sufficient sulfuric acid to at least a major portion of the makeup water under agitation to provide the desired free $H_2SO_4$ content and taking into account that some of the free acid will be subsequently neutralized by the $Na_2O$ or $K_2O$ portions introduced with the silicate. The silicate is added under agitation to the cooled acidic solution until it is completely dispersed. The remaining components are then added. Preferably the peroxide is added last, however, the sequence of addition can be changed without any detrimental effect, provided that the silicate is acidified with sulfuric acid prior to mixing with the hydrogen peroxide, or peroxide decomposition will occur.

The preferred concentrations of the components in the aqueous solution are from about 1.8 g/l to about 18 g/l of free $H_2SO_4$, from about 7 g/l to about 29 g/l of $H_2O_2$, from about 8 g/l to about 18 g/l of $SiO_2$, from about 0.5 to about 2 g/l of the primary organophosphorus promoter and from about 3 to about 10 g/l of the aforementioned secondary promoters.

In order to impart pleasing and lasting colors to the conversion coated work pieces without detrimentally affecting the corrosion resistance of the coating or the stability of the coating solution, it has been found necessary to employ cationic triarylmethane dyes which heretofore predominantly have been used in the dyeing of natural fibers such as paper, cotton, wool, silk, etc. Conventional metal dyes or conversion coating dyes either affect the stability of the system or do not impart any color to the coatings.

The triarylmethane dyes used in this invention are well known in the art and are recognized as a separate generic group of dyes having a Colour Index (C.I.) in the range from 42,000 to 44,999. They are commercially available in a wide variety of colors both in solid form or as aqueous solution concentrates with solids contents typically in the 40–50% range. The effective amount of dye to be added to the conversion coating solution depends obviously on the desired depth of color. Typically, this amount ranges between about 0.05 and about 2 g/l.

The solution is useful for forming conversion coatings on various metallic surfaces, such as those of zinc, cadmium, silver, copper, aluminum, magnesium, and zinc alloys.

The most common application is, however, in the formation of conversion coatings on zinc plated articles such as zinc plated steel articles. The zinc plate provides the steel with cathodic protection against corrosion, and the conversion coating further improves the corrosion resistance, reduces the susceptibility to finger markings and enhances the appearance by chemical polishing of the article and by the color imparted by the dye. It is important that the zinc plate deposit is relatively smooth and fine-grained prior to coating, and that the thickness of the plate deposit is at least 0.005 mm since some metal removal occurs when the film is formed. The preferred plate thickness is between about 0.005 mm and about 0.02 mm.

Usually the formation of the conversion coating follows immediately after the last rinse in the plating cycle. Thus, the freshly plated articles are immersed for a period of from about 5 seconds to about 300 seconds into the solution which is maintained at ambient temperatures. For best results, the immersion treatment is carried out for a duration of from about 20 seconds to about 50 seconds in a bath maintained at temperatures not less than about 20° C. and not more than about 35° C. The coated articles are subsequently rinsed, first in cold water and then briefly in warm water to aid drying of the films. The hot water rinse typically has a temperature in the range of from about 60° to about 70° C. The final step of the coating process is a drying step, which is carried out by any means that will neither abrade the soft and then rather fragile film, nor expose it to excessive temperatures, i.e. temperatures higher than about 70° C. The use of circulating warm air or an airblast are examples of suitable means in the drying operation. After drying, the conversion coatings are quite resistant to damage from abrasion and generally do not require the 12–24 hour aging necessary with conventional chromate conversion coatings.

The resulting conversion coatings have very good resistance to corrosion as determined by the accepted accelerated corrosion test ASTM B-117-64.

During the course of the coating process, the coating solution becomes depleted in both free sulfuric acid and hydrogen peroxide values and must be replenished. Therefore, monitoring of these values should be carried out on a regular basis to assure that the respective concentrations have not fallen below their minima and to assess the amounts needed for replenishment. Free sulfuric acid can be determined by conventional titration methods using sodium hydroxide or by pH determinations. In order to maintain the free sulfuric acid within the broad ranges of about 0.2 to about 45 g/l the pH should be controlled between about 0.5 and about 3.5 and preferably between about 1.0 and about 3.0 which approximately corresponds to a free sulfuric acid concentration of from about 1.8 to about 18 g/l. The hydrogen peroxide concentration levels are advantageously monitored by conventional titration with ceric ammonium sulfate. The silicate ($SiO_2$) consumption is relatively small compared to the consumptions of either the free sulfuric acid or the hydrogen peroxide, and generally neither monitoring (which can be carried out using e.g. colorimetric principles involving the reaction of silicate with ammonium molybdate to form a yellow-colored molybdo silicate solution) nor replenishment is required during the practical life of the conversion coating bath. The rates of consumption (i.e. percent decrease in concentration per unit time) of the primary and secondary additives have been found to be approximately of the same order as that of the hydrogen peroxide consumption. Therefore, replenishments of the solutions with these additives are suitably carried out at the time of hydrogen peroxide replenishment in amounts proportional to the hydrogen peroxide addition. The dye, if present, generally does not need to be replenished during the practical lifetime of the conversion coating bath. Monitoring of the color depth quality of the coating is easily carried out by visual inspection of the coated article and comparison against a reference color.

The following examples are provided to illustrate but not to limit the invention.

The general procedures used in the examples for preparing the conversion coating solutions, test specimens and forming the conversion coatings are described below.

The aqueous conversion coating solutions were each prepared to contain 2.4 g/l free $H_2SO_4$, 16.2 g/l $SiO_2$, 11.7 g/l $H_2O_2$ and 0.85 g/l of 1-hydroxyethylidene-1,1-diphosphonic acid. The $SiO_2$ ingredient was added in the form of sodium silicate ($SiO_2$=33.2% w/w; $Na_2O$=13.85% w/w) and a sufficient excess of sulfuric acid was provided to result in the indicated free $H_2SO_4$ content after neutralization of the $Na_2O$ in the sodium silicate.

Standard Hull cell steel panels (10 cm×6.8 cm ×0.03 cm) were plated with zinc using a cyanide electrolyte. After thorough rinsing and drying, the samples were then immersed for 40 seconds in the conversion coating solution maintained at room temperature. The treated samples were then rinsed in water and then dried with a hot air gun.

The dried coated test specimens were then subjected to the accelerated salt spray corrosion tests in accordance with the ASTM test B-117-64. The tests were carried out for various periods of time, i.e. 6, 16, 24 and 30 hours. After each test the specimens were examined for evidence of corrosion on a rating scale from 1 (heavy corrosion) through 10 (no corrosion).

EXAMPLES 1–3

The beneficial effects of boric acid and zinc gluconate as secondary additives are demonstrated in these examples. The general procedures described above were followed except that the solutions of Examples 2 and 3 also contained the additives indicated in Table 1, which includes the results of the corrosion tests performed on the bright, coated test samples.

TABLE 1

| Ex. No. | Additive | Add. Conc. g/l | Extent of corrosion after 6 hrs. | 24 hrs. |
|---|---|---|---|---|
| Control | 1 None | — | 9 | 7 |
| | 2 Boric Acid | 5 | 10 | 8 |
| | 3 Zn Gluconate | 5 | 9 | 8 |

EXAMPLES 4–12

In this series of experiments all the conversion coating solutions contained triarylmethane dyes in addition to the secondary additives shown in Table 2. These dyes used were a mixture of E. I. DuPont de Nemours' liquid dyes Victoria Pure Blue BOP solution (0.2 ml/l, Basic Blue 7, C.I. 42,595) and Paper Blue R Liquid (0.1 ml/l, Basic Violet 3, C.I. 42,555).

The results of corrosion tests on the bright, colored, coated test specimens are shown in Table 2.

TABLE 2

| Ex. No. | Addditive | Add. Conc. g/l | Extent of corrosion after 16 hrs. | 24 hrs. | 30 hrs. |
|---|---|---|---|---|---|
| Control | None | — | 7 | 6 | 6 |
| 5 | Boric Acid | 5 | 9 | 8 | 7 |
| 6 | Boric Acid | 20 | 9 | 8 | 7 |
| 7 | Ascorbic Acid | 5 | 9 | 8 | 7 |
| 8 | Potassium Sodium Tartrate | 5 | 10 | 8 | — |
| 9 | Glycolic Acid | 5 | 9 | 9 | — |
| 10 | Zn Gluconate | 5 | 9 | 8 | 7 |
| 11 | Na Gluconate | 5 | 9 | 7 | — |
| 12 | Na Gluconate + Zn Sulfate[1] | 3.2 | 9 | 8 | — |

[1]The amount of Zn in 3.2 g $ZnSO_4 \cdot 7H_2O$ is equivalent to that in 0.5% Zn gluconate.

What is claimed is:

1. A conversion coating solution which comprises an aqueous solution of from about 0.2 g/l to about 45 g/l of free $H_2SO_4$, from about 1.5 g/l to about 58 g/l of $H_2O_2$, from about 3 g/l to about 33 g/l of $SiO_2$, from about 0.15 g/l to about 10 g/l of at least one of the organophosphorus compound promoters specified below, and from about 2 g/l to about 20 g/l of at least one secondary promoter selected from the group consisting of ascorbic acid, boric acid, gluconic acid, glycolic acid, tartaric acid and salts of said acids, wherein the organophosphorus compound is one having the general formula:

$$[X(R_1)_m]_n \cdot [R_2]_p \cdot [X(R_1)_m]_q,$$

wherein

X is a group of the formula

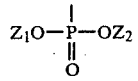

in which $Z_1$ and $Z_2$ independent from each other are hydrogen, sodium or potassium;

m is either 0 or 1;

p is either 0 or 1;

n+q is either (a) 1 when P=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

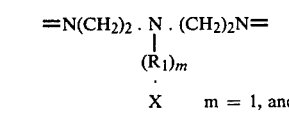

(c)

m = 1, and (d) a $C_1$–$C_4$ alkylene or a $C_1$–$C_4$ hydroxy-substituted alkylene m=0 or 1.

2. The solution of claim 1, wherein the free $H_2SO_4$ concentration is between about 1.8 g/l and about 18 g/l.

3. The solution of claim 1, wherein the $H_2O_2$ concentration is between about 7 g/l and about 29 g/l.

4. The solution of claim 1, wherein the $SiO_2$ concentration is between about 8 g/l and about 18 g/l.

5. The solution of claim 1, in which the $SiO_2$ is provided in the form of sodium silicate or potassium silicate.

6. The solution of claim 5, wherein the molecular ratio of $SiO_2$ to either $Na_2O$ or $K_2O$ in the sodium silicate or potassium silicate is maintained between about 1 and about 4.

7. The solution of claim 6, wherein said molecular ratio is at least about 2.2.

8. The solution of claim 1, containing from about 0.5 to about 2 g/l of said organophosphorus compounds.

9. The solution of claim 8, wherein the organophosphorus compound is a hydroxyalkylene disphosphonic acid.

10. The solution of claim 9, wherein the organophosphorus compound is 1-hydroxyethylidene-1,1-diphosphonic acid.

11. The solution of claim 1, wherein the secondary promoter is added in amounts between about 3 and about 10 g/l.

12. The solution of claim 1, wherein the secondary promoter is ascorbic acid.

13. The solution of claim 1, wherein the secondary promoter is boric acid.

14. The solution of claim 1, wherein the secondary promoter is glycolic acid.

15. The solution of claim 1, wherein the secondary promoter is a salt of gluconic acid.

16. The solution of claim 1, wherein the secondary promoter is a salt of tartaric acid.

17. The solution of claim 15, wherein the salt is zinc gluconate.

18. The solution of claim 15, wherein the salt is sodium gluconate.

19. The solution of claim 16, wherein the salt is a sodium-potassium tartrate.

20. The solution of claim 1, containing additionally an effective amount of at least one cationic triarylmethane dye.

21. The solution of claim 20, in which the dye concentration ranges between about 0.05 to about 0.3 grams/liter on a dry basis.

22. The solution of claim 20, in which at least one of the dyes is Basic Violet 3 having a Colour Index of 42,555.

23. The solution of claim 20, in which at least one of the dyes is Basic Blue 7 having a Colour Index of 42,595.

24. In a process for the formation of a corrosion resistant conversion coating onto metallic surfaces selected from zinc, cadmium, silver, copper, aluminum, magnesium and zinc alloys, wherein the metallic surfaces are immersed in a conversion coating solution, and subsequently rinsed and dried, the improvement which comprises:

immersing the metallic surface into the conversion coating solution of claim 1.

25. In a process for the formation of a corrosion resistant conversion coating onto metallic surfaces selected from zinc, cadium, silver, copper, aluminum, magnesium and zinc alloys, wherein the metallic surfaces are immersed in a conversion coating solution, and subsequently rinsed and dried, the improvement which comprises:

immersing the metallic surface into the conversion coating solution of claim 20.

26. A metallic surface coated by the process of claim 24.

27. A metallic surface coated by the process of claim 25.

28. The metallic surface of claim 26 wherein the metal is zinc plate.

29. The metallic surface of claim 27 wherein the metal is zinc plate.

* * * * *